United States Patent [19]

Eltze et al.

[11] Patent Number: 4,706,627

[45] Date of Patent: Nov. 17, 1987

[54] SPEED GOVERNOR FOR INJECTION PUMPS IN INTERNAL COMBUSTION ENGINES

[75] Inventors: Georg Eltze, Stuttgart; Wendelin Kluegl, Kernen; Frank Thoma, Stuttgart, all of Fed. Rep. of Germany

[73] Assignee: Daimler-Benz Aktiengesellschaft, Stuttgart, Fed. Rep. of Germany

[21] Appl. No.: 601,022

[22] Filed: Apr. 16, 1984

[30] Foreign Application Priority Data

Apr. 15, 1983 [DE] Fed. Rep. of Germany ..... 3313632

[51] Int. Cl.[4] ..... F02M 39/00

[52] U.S. Cl. ..... 123/365; 123/370; 123/373

[58] Field of Search ..... 123/365, 370, 373, 388, 123/378, 385; 180/172, 174

[56] References Cited

U.S. PATENT DOCUMENTS

| | | | |
|---|---|---|---|
| 2,986,291 | 5/1961 | Schick | 123/373 |
| 4,076,094 | 2/1978 | Moody | 180/172 |
| 4,150,650 | 4/1979 | Tsumura | 123/373 |
| 4,286,558 | 9/1981 | Djordjeuic | 123/373 |
| 4,493,303 | 1/1985 | Thompson | 123/357 |

FOREIGN PATENT DOCUMENTS

| | | | |
|---|---|---|---|
| 1148811 | 5/1963 | Fed. Rep. of Germany | 123/373 |
| 3018720 | 11/1981 | Fed. Rep. of Germany | 123/373 |
| 3027671 | 2/1982 | Fed. Rep. of Germany | 123/373 |
| 46-29579 | 8/1971 | Japan | 123/373 |
| 1121692 | 7/1968 | United Kingdom | 123/373 |
| 1259748 | 1/1972 | United Kingdom | 123/373 |
| 1450364 | 9/1976 | United Kingdom | 123/373 |
| 1470742 | 4/1977 | United Kingdom | 123/373 |
| 1483771 | 8/1977 | United Kingdom | 123/373 |
| 2041568 | 9/1980 | United Kingdom | 123/365 |
| 2106268 | 4/1983 | United Kingdom | 123/373 |
| 499414 | 3/1976 | U.S.S.R. | 123/370 |

*Primary Examiner*—Carl Stuart Miller

[57] ABSTRACT

A speed governor for injection pumps in internal combustion engines with a regulating sleeve which at maximum rotational speed of the internal combustion engine is displaced as a function of speed within the regulating sleeve travel against the force of the main regulating spring that acts on a force transmitting lever. The regulating movements of the force-transmitting lever are transmitted onto the fuel delivery adjusting member of the injection pump by means of at least one intermediate lever. The internal combustion engine rotational speed can be influenced by means of an operating element adapted to be controlled. In case of a needed change of the beginning of the full-load speed regulation of the internal combustion engine, the spring travel of the main regulating spring is influenced by means of a force-transmitting element.

16 Claims, 3 Drawing Figures

SPEED GOVERNOR FOR INJECTION PUMPS IN INTERNAL COMBUSTION ENGINES

Figure 1:
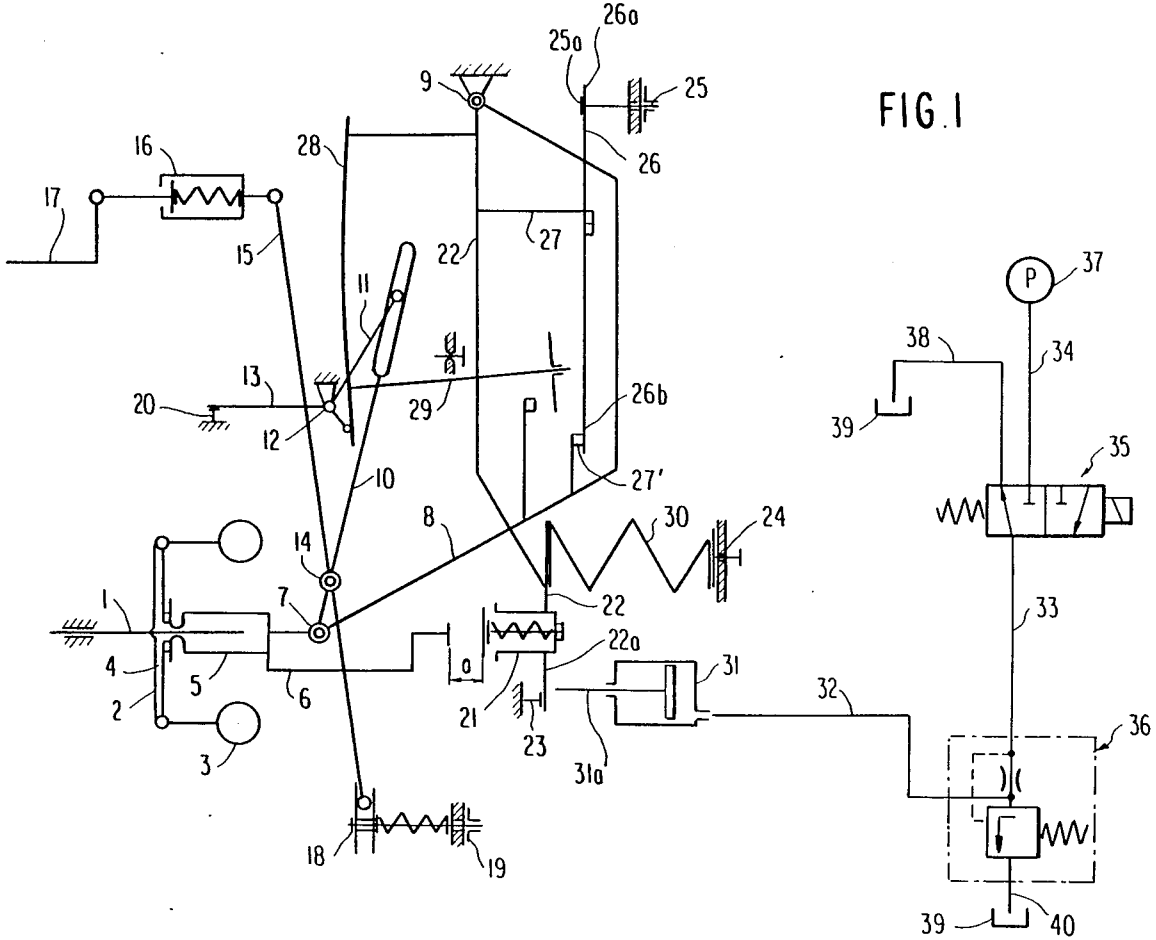

The present invention relates to a speed governor for injection pumps in internal combustion engines with a regulating sleeve which at maximum speed of the internal combustion engine is adjusted as a function of speed within the control sleeve travel against the force of the main regulating spring acting on a force-transmitting lever, and in which the regulating movements of the force-transmitting lever are adapted to be transmitted onto the fuel delivery adjusting member of the injection pump by means of at least one intermediate lever.

A speed governor for injection pumps in internal combustion engines with a flyweight device connected with the cam shaft of the injection pump is disclosed in the German Offenlegungsschrift No. 30 18 720. An abutment cooperating with a leaf spring influences the full-load speed regulation curve to the effect that the speed governor has only a full-load speed regulation characteristic curve which remains the same.

Furthermore, a speed regulating device for injection internal combustion engines, especially for a centrifugal speed governor of an injection pump for diesel engines of motor vehicles is disclosed in the German Offenlegungsschrift No. 29 02 731 in which an electrically driven adjusting member engages at the movable parts of the governor for the control of the idling position of the fuel delivery adjusting member, as a result of which a correction of the idling rotational speed of the internal combustion engine can be realized in dependence on the operating magnitude. The adjusting force of the adjusting member for the control of the idling rotational speed of the internal combustion engine is superimposed on the regulating forces of the idling spring, and effects an adjustment of the fuel delivery adjusting member and thus an increase of the idling rotational speed of the internal combustion engine.

It is the principal object of the present invention to influence a speed-regulating device of the aforementioned type in such a manner that the speed regulating device has different full-load speed regulating characteristic curves.

The underlying problems are solved according to the present invention in that a change, as needed, of a full-load speed regulation beginning of the internal combustion engine rotational speed is adapted to be realized by means of a force-transmitting element influencing the spring travel of the main regulating spring.

By the construction in accordance with the present invention of a speed-regulating device or centrifugal governor for injection pumps in internal combustion engines, a temporarily higher internal combustion engine-rotational speed may be readied, for example, for the safe handling of a critical driving situation in an overtaking operation, whereby it is assured at the same time that the internal combustion engine is not thermally and mechanically overloaded.

Figure 2:
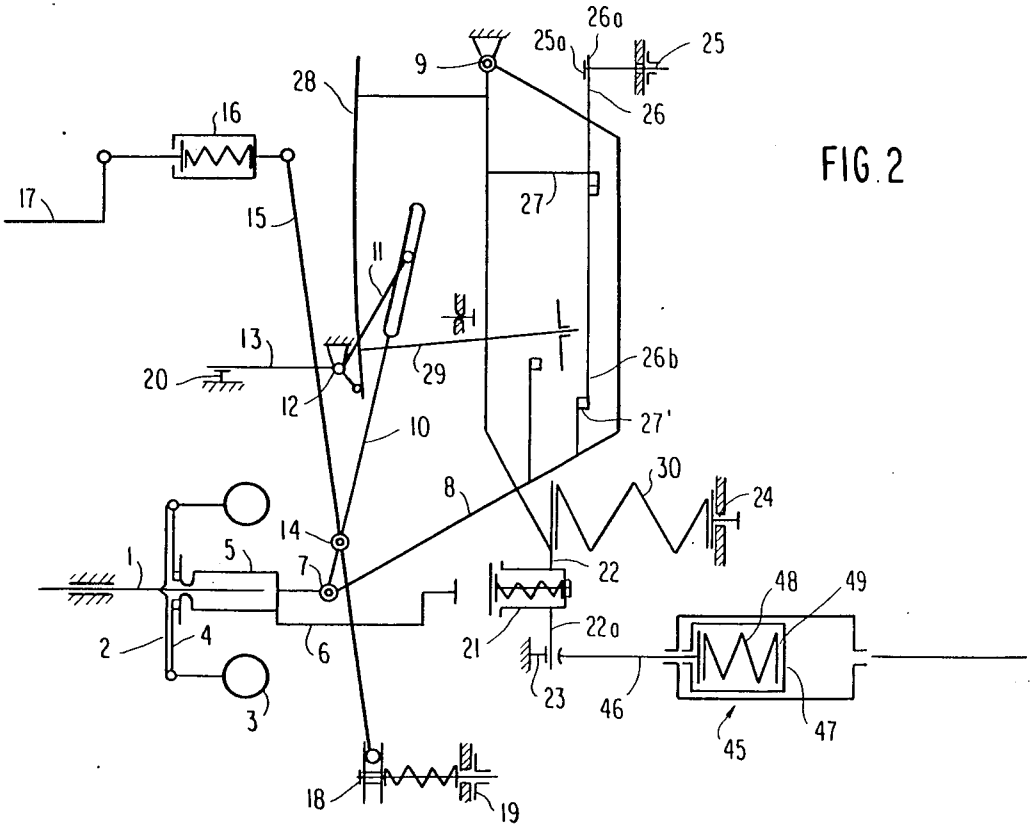
Figure 3:
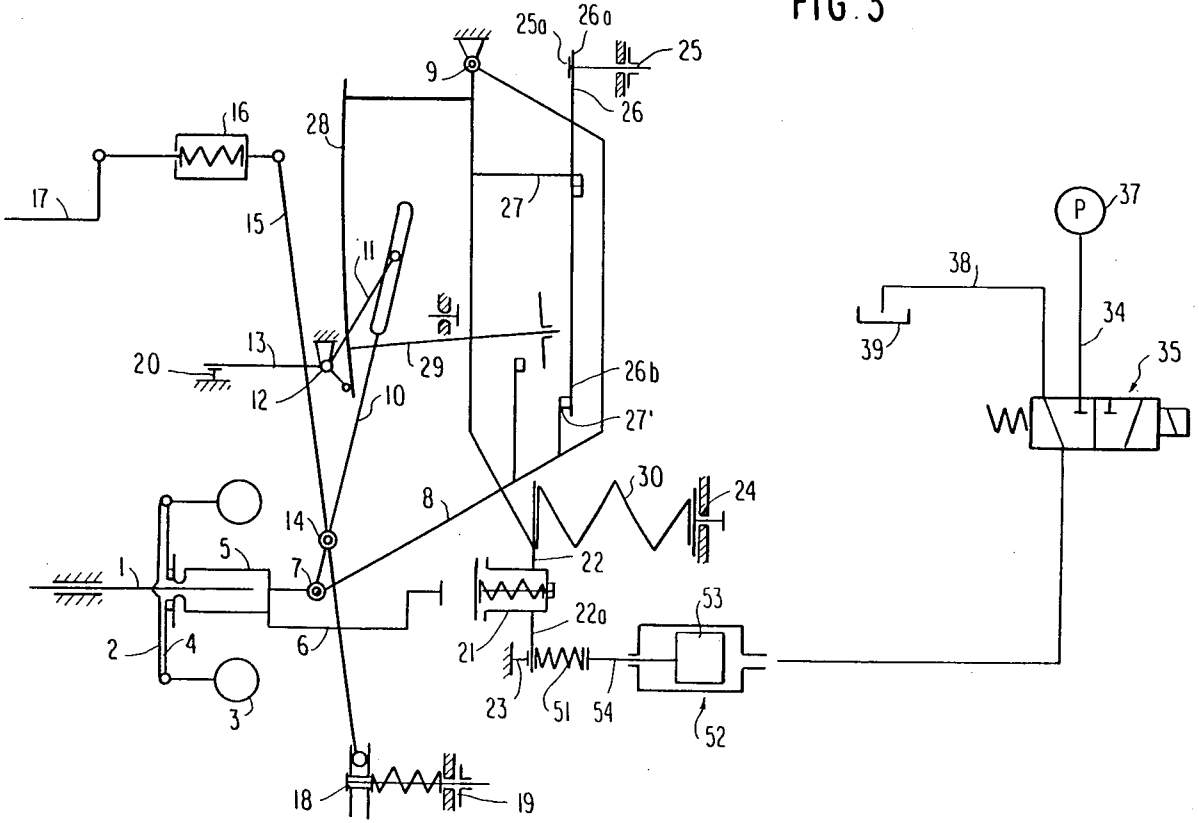

These and other objects, features and advantages of the present invention will become more apparent from the following description when taken in connection with the accompanying drawing which shows, for purposes of illustration only, three embodiments in accordance with the present invention and wherein:

FIG. 1 is a schematic view of a speed-regulating device and of an installation for the change of the beginning of the full-load speed regulation of the internal combustion engine rotationalspeed in accordance with the present invention;

FIG. 2 is a schematic view of a modified embodiment of a rotational speed-regulating device with a single acting hydraulic cylinder having a safety device to be overcome by pressure in accordance with the present invention; and FIG. 3 is a schematic view of still another modified embodiment of a speed-regulating device with a prestressed change-mechanism for a regulating spring in accordance with the present invention.

Referring now to the drawing wherein like reference numerals are used throughout the various views to designate like parts, and more particularly to FIG. 1, a flyweight carrier 2 of a centrifugal speed governor constructed as idling-speed and full-load rotational speed regulating device, is secured on a cam shaft 1 of a conventional injection pump (not shown) for internal combustion engines. Flyweights 3 are thereby pivotally supported at the flyweight carrier 2. The flyweights 3 engage by means of pressure arms 4 at a control or regulating sleeve 5 serving as regulating element, which transmits onto a sleeve lever 6 the sleeve travel effected by the flyweights 3. The sleeve lever 6 is pivotally connected by means of a pivot pin 7 at a guide lever 8 which in turn is pivotally connected at a fixed part by a pivot pin 9 serving as axis of rotation and thus guides the control sleeve 5 during its stroke movements. A reverse-transfer lever 10 is additionally pivotally connected with the sleeve lever 6 by the pivot pin 7; the reverse-transfer lever 10 is additionally connected with a levershaped adjusting member 11. The adjusting member 11 is secured on a lever shaft 12 which serves as pivot axis and which can be actuated by means of an actuating lever 13. The reverse-transfer lever 10 is connected by way of a bearing place 14 with an intermediate lever 15 serving as regulating lever, which, on the one hand, is pivotally connected by way of an elastically yielding connecting device 16 with a control rack 17 serving as fuel delivery adjusting member of the injection pump and, on the other, is supported at a pivot bearing 18.

The pivot bearing 18 of the intermediate lever 15 is fixed in the axial direction of the regulating sleeve 5 by an adjusting screw 19 and can be changed by rotation of the adjusting screw 19 to the base adjustment of the full-load position of the control rack 17 determining the amount of full-load fuel delivery, if the indicated start and full-load position of the actuating lever 13 and therewith of the adjusting member 11 is determined by a non-adjustable full-load abutment 20 fixed at the housing.

If the control sleeve 5 has traversed an idling sleeve travel designated by a, then the sleeve lever 6 abuts at an adapter spring retainer 21 serving in this case as travel stop. The adapter spring retainer 21 is secured in a force-transmitting lever 22 serving as force-transmitting member which is pivotal about the pivot pin 9 and is pressed with its free end **22*a* against an abutment 23 fixed at the housing by a main regulating spring 30. The prestress force of the main regulating spring 22 serving as full-load speed regulating spring is determined by the installed position and can be adjusted by an abutment 24. An adjusting screw 25 serves for the correction of the idling rotational speed. A stop 25*a* of the adjusting screw 25 serves as adjustable abutment for an end 26*a* of an idling spring 26 constructed as leaf spring which is supported at the force-transmitting lever 22 by way of a stop block 27 serving as fixed support, respectively, as catch bracket, and which presses with its other end 26b opposite the abutment 25a against an abutment 27' at the guide lever 8**.

An auxiliary idling spring 28 which is constructed as leaf spring is secured at the force-transmitting lever 22 approximately at the height where the stop block 27 is secured thereto, whereby the auxiliary idling spring 28 is provided with a connecting element 29. A piston rod 31a of a single-acting cylinder 31 is operatively connected with the force-transmitting lever 22. The cylinder 31 is connected with lines 32, 33 by means of a 3/2-way valve generally designated by reference numeral 35 which in turn is connected with a pressure source 37 by means of a line 34. Any leakage from the 3/2-way valve 35 is conducted by means of a line 38 to a collecting tank 39, to which is also fed leakage from a pressure-limiting valve generally designated by reference numeral 36 by way of a line 40.

In case of need of a temporary higher full-load rotational speed of an internal combustion engine, the 3/2-way valve 35 is actuated, which opens up the throughflow of a pressure medium from the pressure source 37 to the single-acting cylinder 31. The piston rod 31a of the cylinder 31 is displaced toward the force-transmitting lever 22 and reinforces the force which the main regulating spring 30 exerts on the force-transmitting lever 22. The full-load speed regulation of the internal combustion engine rotational speed, which would otherwise commence by way of the control sleeve 5, the sleeve lever 6 and the adapter spring retainer 21 pressing against the main regulating spring 30 by means of the force-transmitting lever 22 rigidly connected therewith, and which would cause at the same time the retraction of the control rack 17 by way of the regulating sleeve 5, the reverse-transfer lever 10 and the intermediate lever 15, when the force of the centrifugal governor 2, 3 exceeds the spring force of the main regulating spring 30, is delayed until the adjusting force of the main regulating spring 30 and that of the cylinder 31 which act on the force-transmitting lever 22, is smaller than the adjusting force of the flyweights 3 which acts on the force-transmitting lever 22 by way of the regulating sleeve 5, the sleeve lever 6 and the adapter spring retainer 21.

The control of the 3/2-way valve 35 can take place, for example, in dependence of the velocity of the motor vehicle, of the engaged transmission speed and/or with predetermined time delay.

In a modified embodiment of the present invention, the adjusting force to be applied on the force-transmitting lever 22 can also take place by means of electrically or pneumatically driven adjusting members. For example, the internal combusticn engine oil circulation or an automatic transmission oil circulation may be used as pressure source 37.

The embodiment illustrated in FIG. 2 differs from that illustrated in FIG. 1 by the construction of the single-acting cylinder. A single-acting cylinder generally designated by reference numeral 45 includes a piston rod 46, a piston 47 and a spring 48. In its function as a pressure-detent element, the spring 48 is supported, on the one hand, on the piston rod 46 and, on the other, within the piston area 49 of the piston 47.

When the piston 47 is blocked in the cylinder 45 in its illustrated position due to the admission of pressure medium into the cylinder, the adjusting force of the flyweights 3 acts by way of the regulating sleeve 5, the sleeve lever 6 and the adapter spring retainer 21 on the force-transmitting lever 22 which is now displaced against the combined adjusting force of the main regulating spring 30 and of the spring 48 so that the effect of the blocking piston 47 is an earlier compression of the spring 48 to permit a temporary higher full-load rotational speed of the engine. The full-load speed regulation is otherwise carried out in a known manner.

In the further embodiment according to FIG. 3, an additional spring 51 acting on the force-transmitting lever 22 is coordinated to the main regulating spring 30; the spring 51 thereby partakes in the determination of the normally adjusted full-load speed regulation commencement of the internal combustion engine. A prestress change of the spring 51 is adjustable by means of a single-acting hydraulically actuatable cylinder 52.

In case of need of a full-load speed regulation of the internal combustion engine providing a higher full-load rotational speed, the 3/2-way valve 35 is actuated, which opens up the pressure medium supply from the pressure source 37 to the cylinder 52, as a result of which a piston 53 to which a piston rod 54 is coordinated, is displaced in the cylinder 52 and the prestress of the spring 51 is increased. The beginning of the full-load speed regulation then takes place only when the adjusting force of the flyweights 3 is larger than the adjusting force of the main regulating spring 30 and of the prestressed spring 51. The full-load speed regulation of the internal combustion engine takes place otherwise in a conventional manner.

While we have shown and described several embodiments in accordance with the present invention, it is understood that the same is not limited thereto but is susceptible of numerous changes and modifications as known to those skilled in the art. For example, a lower full-load speed regulation beginning of the internal combustion engine can be initiated by a decrease of the prestress force of the main regulating spring. Accordingly, we do not wish to be limited to the details shown and described herein but intend to cover all such changes and modifications as are encompassed by the scope of the appended claims.

We claim:

1. A speed governor for fuel injection pumps of an internal combustion engine having a centrifugal device adjusting a governor collar as a function of speed, which device acts on a transmission lever against the force of a main control spring to set a maximum speed for the internal combustion, said transmission lever having a first end, said main control spring applying its force to the transmission lever at a point located away from said first end, said main control spring being supported at an adjustable counterbearing mechanism for adjusting the fuel regulating force of said main control spring, at least one intermediate lever transmitting motions from the transmission lever to regulate a fuel delivery volume adjusting member of the injection pump, a hydraulically operable cylinder connected to and applying a force to said first end of the transmission lever in a direction parallel to that of the main control spring force wherein the fuel regulating motion of the transmission lever caused by the main control spring force is increased for reaching a short term increased nominal speed of the internal combustion engine over the set maximum speed when the hydraulically operated cylinder is actuated, and wherein the governor collar, in response to the centrifugal device, acts on the transmission lever in opposition to the parallel forces produced by the main control spring and the hydraulically actuated cylinder to cause fuel to be reduced when the increased nominal speed is reached.

2. A speed governor according to claim 1, wherein the cylinder is a single-acting hydraulically actuatable cylinder having a piston rod which acts on the transmission lever in opposition to the governor cylinder.

3. A speed governor according to claim 2, wherein a further spring is coordinated to the main control spring means, and wherein the prestress of said further spring is adjustable by means of the single-acting hydraulically actuatable cylinder.

4. A speed governor according to claim 2, wherein the single-acting hydraulically actuatable cylinder includes a piston in which is arranged a member to be overcome by pressure and includes a spring.

5. A speed governor according to claim 4, wherein said single-acting hydraulically actuatable cylinder includes a piston rod operable to act upon the spring arranged in the piston.

6. A speed governor according to claim 1, wherein a further spring is coordinated to the main control spring means, and wherein the prestress of said further spring is by means of said hyraulically actuatable cylinder which is single-acting.

7. A speed governor according to claim 1, wherein the cylinder is a single-acting hydraulically actuatable cylinder having a piston in which is arranged a member to be overcome by pressure and includes a spring.

8. A speed governor according to claim 7, wherein said single-acting hydraulically actuable cylinder includes a piston rod operable to act upon the spring arranged in the piston.

9. A speed governor in accordance with claim 1, wherein the governor is utilized on a vehicle, and wherein the hydraulic cylinder is caused to apply its force in response to vehicle speed.

10. A speed governor in accordance with claim I, wherein the governor is utilized on a vehicle having a transmission, and wherein the hydraulic cylinder is caused to apply its force in response to vehicle transmission speed.

11. A speed governor according to claim 9, wherein the cylinder is a single-acting hydraulically actuatable cylinder having a piston rod which acts on the transmission lever in opposition to the governor collar.

12. A speed governor according to claim 10, wherein the cylinder is a single-acting hydraulically actuatable cylinder having a piston rod which acts on the transmission lever in opposition to the governor collar.

13. A speed governor according to claim 9, wherein a further spring is coordinated to the main control spring means, and wherein the prestress of said further spring is adjustable by means of the single-acting hydraulically actuatable cylinder.

14. A speed governor according to claim 10, wherein a further spring is coordinated to the main control spring means, and wherein the prestress of said further spring is adjustable by means of the single-acting hydraulically actuatable cylinder.

15. A speed governor according to claim 11, wherein a further spring is coordinated to the main control spring means, and wherein the prestress of said further spring is adjustable by means of the single-acting hydraulically actuatable cylinder.

16. A speed governor according to claim 12, wherein a further spring is cooordinated to the main control spring means, and wherein the prestress of said further spring is adjustable by means of the single-acting hydraulically actuatable cylinder.

* * * * *